United States Patent [19]

James et al.

[11] Patent Number: 4,625,894

[45] Date of Patent: Dec. 2, 1986

[54] NEWSPAPER VENDING MACHINE

[76] Inventors: Harold K. James, 510 N. Main St., Space 3; Joseph L. McNeese, 555 Moffat Blvd., Space 53, both of Manteca, Calif. 95336

[21] Appl. No.: 553,680

[22] Filed: Nov. 21, 1983

[51] Int. Cl.[4] ..... B65H 3/28

[52] U.S. Cl. ..... 221/193; 221/195; 221/231

[58] Field of Search ..... 221/192–195, 221/226, 231–232, 221–223, 254, 277

[56] References Cited

U.S. PATENT DOCUMENTS

| | | | |
|---|---|---|---|
| 1,022,680 | 9/1912 | Johnson . | |
| 1,324,415 | 12/1919 | Smith | 221/232 X |
| 1,749,773 | 3/1930 | Matchett . | |
| 1,813,299 | 7/1931 | Laughlin . | |
| 1,914,546 | 6/1933 | Whiting | 221/232 |
| 2,255,538 | 9/1941 | Cameron . | |
| 2,396,411 | 3/1946 | Cameron . | |
| 2,510,197 | 6/1950 | Summerfield | 221/195 X |
| 3,180,518 | 4/1965 | Roser . | |
| 3,685,691 | 8/1972 | Charest et al. . | |
| 3,980,204 | 9/1976 | DuBroff et al. | 221/277 X |

FOREIGN PATENT DOCUMENTS

| | | | |
|---|---|---|---|
| 367588 | 3/1973 | U.S.S.R. | 221/222 |

*Primary Examiner*—Charles A. Marmor

[57] ABSTRACT

A vending machine for dispensing a single, folded, rectangular newspaper from a group of abutting similar newspapers has a frame and housing with an interior, bottom support plate inclined downwardly toward and ending at a forward edge spaced from the front wall of the housing. A barrier extends transversely at the forward edge of the bottom plate, is spaced from the front wall to leave an opening and is adapted to be abutted by the lower folded edge of the leading newspaper. A movable back support wall is spring-urged over the bottom plate and toward the barrier to advance newspapers along the bottom plate. The forward folded newspaper, when pressed against the barrier by the back wall, also rests above or upon one or more drum cams, each having a support surface for a newspaper fold and having a separator fin. Each drum cam is mounted on a shaft rotatable by a handle and returned by a spring. Upon rotation, the drum cams separate the forward newspaper from the group and lift the separated forward newspaper upwardly and over the barrier to release the lifted newspaper for discharge by gravity through a vertical chute having a dispensing opening at the bottom. The drum cams, in their dispensing positions, act to arrest the forward motion of the succeeding newspapers and do so until the drum cams have been restored to their home positions.

10 Claims, 9 Drawing Figures

NEWSPAPER VENDING MACHINE

BRIEF SUMMARY OF THE INVENTION

Disposed in a housing is a bottom plate in part supporting a plurality of similar, folded newspapers arranged to abut each other in order and at their bottom folds resting on the bottom plate. This plate is inclined forwardly and downwardly toward a front barrier adjacent a dispensing opening. The barrier is separated from some parts of the forward edge of the bottom plate to leave intervening spaces. Duplicate drum cams are in the spaces and on shafts rotatable one way by a handle and returned by a spring. The drum cams in one rotated position thereof have portions well below the barrier and about in line with the bottom plate. A back plate is spring-pressed to travel forwardly above the bottom plate so as to urge the newspapers forwardly. The front newspaper is thus pressed against the barrier and rests with its bottom fold above the drum cams. Operation of the handle rotates the drum cams first to separate the forward newspaper from the succeeding newspapers and then to lift the separated, forward newspaper above and across the barrier for gravity discharge through the dispensing opening. The remaining newspapers are pressed forwardly by the back plate, and when the drum cams return to their original position the cycle can be repeated.

INFORMATION DISCLOSURE STATEMENT

Reference is made to the following United States patents:

| | | |
|---|---|---|
| 1,022,680 | April 9, 1912 | Johnson |
| 1,749,773 | March 11, 1930 | Matchett |
| 1,813,299 | July 7, 1931 | Laughlin |
| 2,255,538 | September 9, 1941 | Cameron |
| 2,396,411 | March 12, 1946 | Cameron |
| 3,180,518 | April 27, 1965 | Roser |
| 3,685,691 | August 22, 1972 | Charest et al. |

Explanation:

U.S. Pat. No. 1,022,680 does not involve any lifting of the newspaper being dispensed.

U.S. Pat. No. 1,749,773 advances a newspaper between feed rolls but does not lift the newspaper over a barrier for release.

U.S. Pat. No. 1,813,299 does not dispense a newspaper by lifting it over a barrier.

U.S. Pat. No. 2,255,538 has no barrier over which a newspaper to be dispensed is lifted.

U.S. Pat. No. 2,396,411, while raising a paper as part of the dispensing motion, does not first segregate the paper to be dispensed from the remaining papers.

U.S. Pat. No. 3,180,518 uses needles to pierce the newspaper to shift its position for dispensing.

U.S. Pat. No. 3,685,691 employs an approximately helical disc of a diameter approximately twice the size of a folded newspaper and a correspondingly large enclosure.

DETAILED DESCRIPTION

Figure 1:
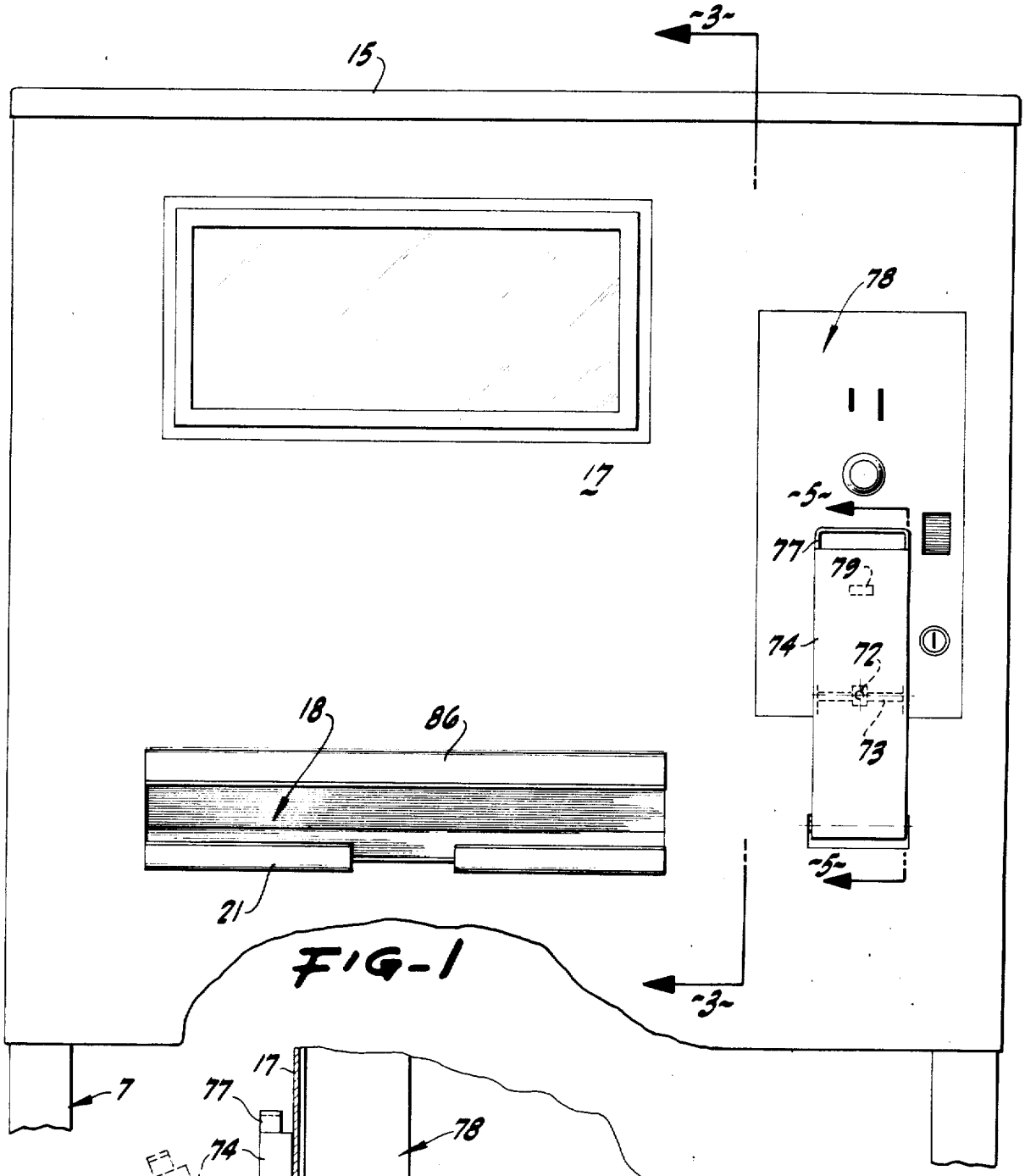
FIG. 1 is a front elevation of a newspaper vending machine pursuant to the invention.

While the environments and particular uses of the disclosed newspaper vending machine vary considerably, in a typical instance the vending machine is supported on a base 7 at a convenient height. The machine has a housing 8 which incorporates reenforcing members and also acts as and is referred to as a frame. Preferably, the housing includes a pair of side walls 12 and 13, a rear wall 14, a removable top wall 15, held in place by a keyed lock 16, and also includes a windowed front wall 17 formed with a dispensing opening 18 therein. The opening is of appropriate dimensions to pass a single folded newspaper. The opening 18 is especially related to a barrier 19 spaced from the front wall 17 and is characterized by relation to one or more transverse, lower receiving shelves 21.

Within the housing 8 there is conveniently mounted a stationary bottom plate 26 arranged to extend forwardly and downwardly from the vicinity of the rear wall 14 toward the front wall 17 and is inclined forwardly and downwardly at a suitable angle or slope to assist in the forward urging and advancement of a group of newspapers 31, 32, etc. arranged on the bottom plate 26 with their folds 33 at the bottom and disposed one behind the other. The forward newspaper preferably in part rests against and is stopped by the barrier 19. Serving as the barrier are one or more transversely aligned angle members fast on the frame and having upstanding flanges 36 higher than the adjacent bottom plate and much higher than the bottom of the opening 18.

In order to urge the newspapers in a forward direction, there is afforded an inclined, movable back wall 38, carried by supporting sleeves 39. These are located on opposite sides of and beyond the ends of the newspapers and are slidable on inclined rods 41 and 42 spanning the interior of the housing substantially parallel to the bottom plate 26. The rods 41 and 42 at their ends are supported in brackets 43 and 44 extending upwardly from the bottom of the frame 8. Urging the back wall 38 and the group of newspapers forwardly are springs 46 engaging extensions 47 respectively secured to the brackets 43 and engaging extensions 48 respectively secured to the sleeves 39.

The bottom plate 26 is spaced from the barrier 19, comprised conveniently of several angle irons preferably separated transversely of the housing to leave intervening spaces 49 or gaps. In the spaces or gaps 49 there are one or more drum cams 51. A minimum of one drum cam can be arrayed under the transverse center of the bottom of the newspapers when the newspapers are reasonably well confined or guided at their opposite sides. But it is preferred to use a pair of laterally spaced drum cams 51 so that the load is evenly supported and side guides are not necessary. Each drum cam 51 is mounted in a respective one of the gaps 49 in the barrier 19 and is mounted on the forward end of its respective one of two support shafts 52 carried in journals 53 on the frame 8.

Figure 7:
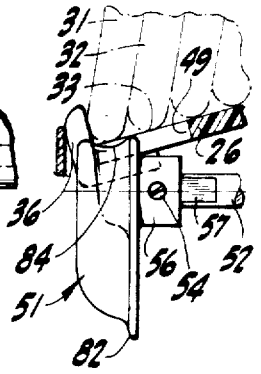
FIG. 7 is in part a cross-section and in part a side elevation of a cam drum and its immediate environment, the cam drum being in the position shown in FIG. 6.
Figure 3:
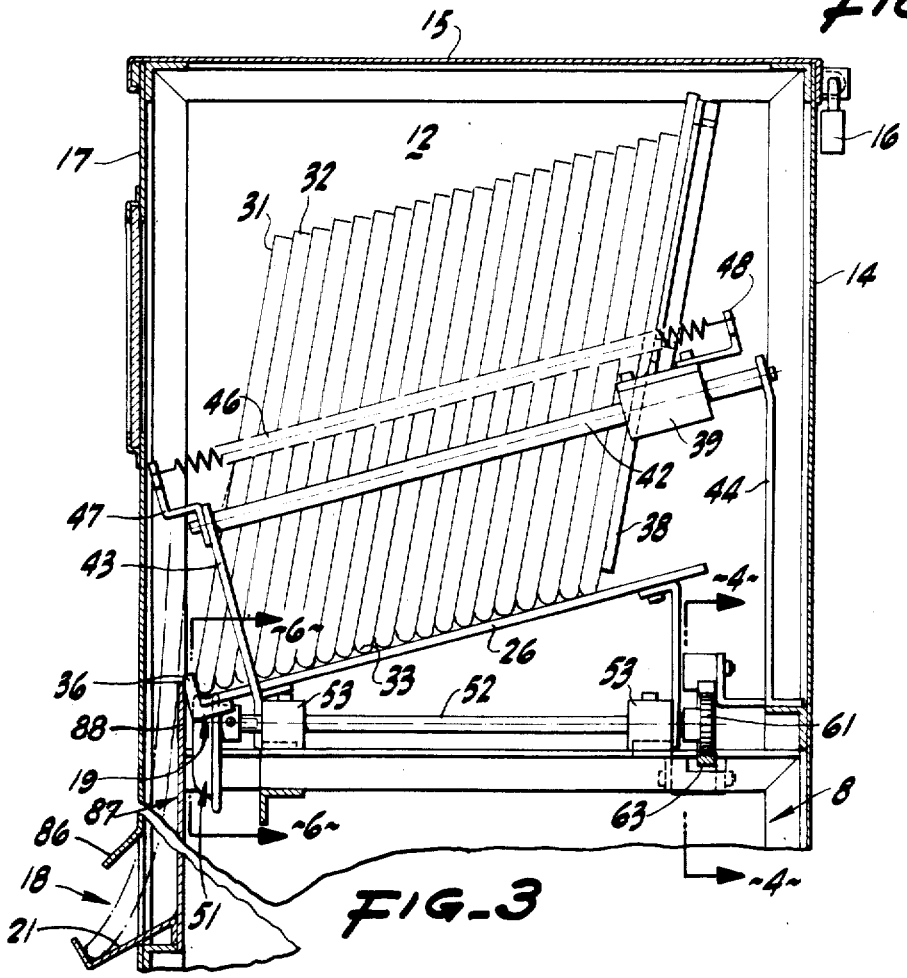
FIG. 3 is a cross-section, the plane of which is indicated by the line 3—3 of FIG. 1.

Each drum cam is preferably secured for rotation with its shaft 52 and for some fore and aft sliding or adjustment movement. This is arranged by means of a set screw 54 (FIG. 7) acting through the hub 56 of the cam against a flat 57 on the shaft. When the set screw is loose, the cam and its hub can be moved axially of the shaft and then can be locked into position by tightening of the set screw. This compensates for newspapers of markedly different thickness.

Figure 4:
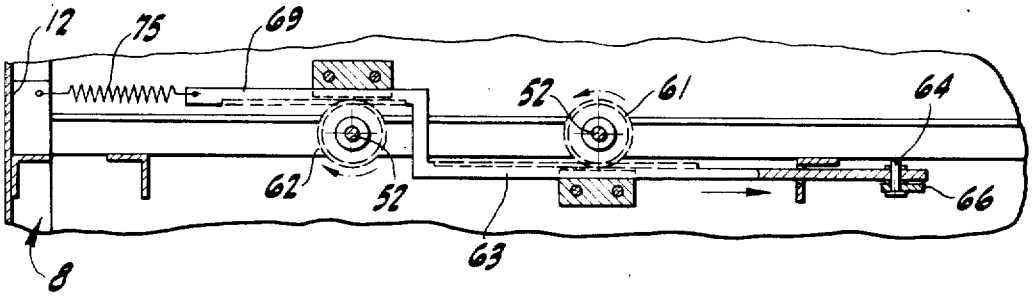
FIG. 4 is a detail in cross-section, the plane of which is indicated by the line 4—4 of FIG. 3.
Figure 8:
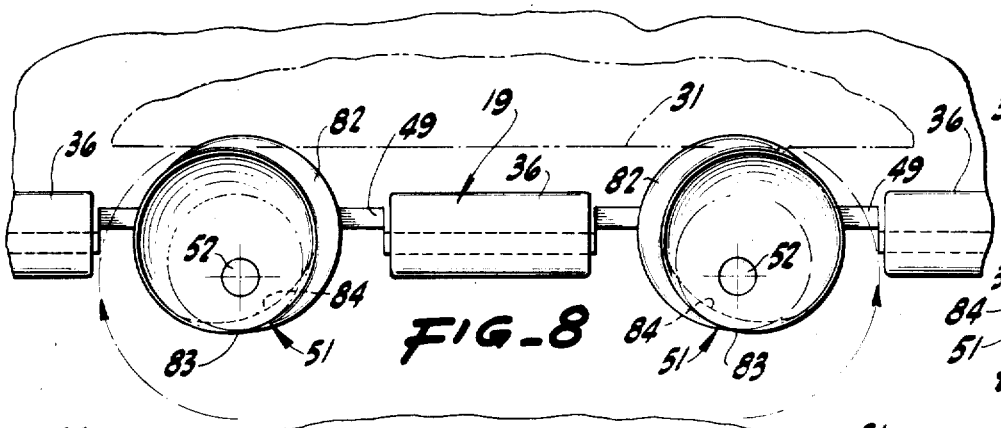
FIG. 8 is a view like FIG. 6 but showing the cam drums in another extreme position.
Figure 9:
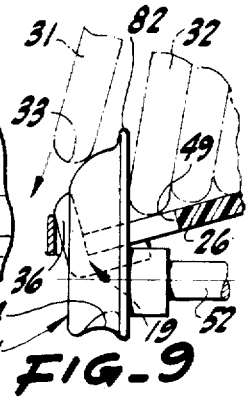
FIG. 9 is a view like FIG. 7 but showing the cam drum in the extreme position of FIG. 8.
Figure 6:
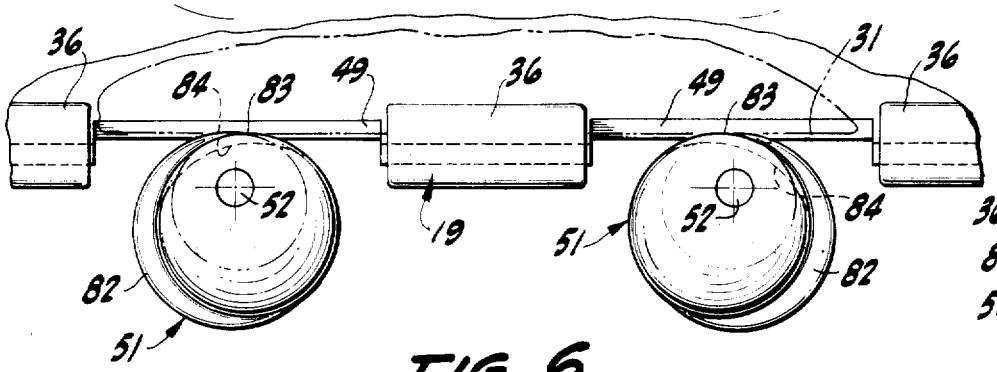
FIG. 6 is a detail in cross-section on the line 6—6 of FIG. 3, showing the drum cams in one extreme position.

The shafts 52 for the drum cams are provided at their opposite, driven ends with individual pinion gears 61 and 62. The bottom of the pinion 61 is in mesh with a transversely translatable bottom leg 63 of a rack bar (FIG. 4). This rack bar is connected by a pin 64 to a slotted bell crank plate 66 mounted on a pivot 67 on the frame. The top of the pinion 62 is in mesh with the top leg 69 of the rack bar and so is joined to the pin 64.

Figure 5:
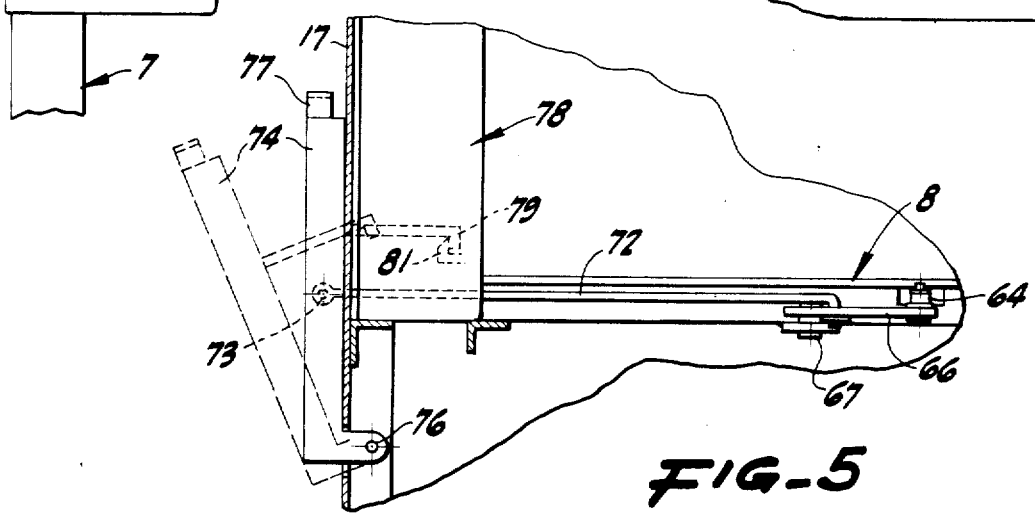
FIG. 5 is a detail in cross-section, the plane of which is indicated by the line 5—5 of FIG. 1.

To the bell crank plate 66 is connected an actuating rod 72 extending forwardly and engaged with an actuator handle 74 by a pivot connection 73 (FIG. 5) just outside the front wall 17 of the enclosure. The actuator handle at the bottom is mounted on a fulcrum shaft 76 and at the top has a hand grip 77 for ready pulling. When the grip is manually pulled, it rotates the bell crank plate 66 and oscillates the racks 63 and 69 simultaneously to rotate the shafts 52 in opposite directions. A spring 75 (FIG. 4) resists the movement of the racks 63 and 69 and resists the forward movement of the rod 72. When the actuator handle 74 is released, the spring 75 returns the connected parts to their initial positions.

In some installations there may be free operation of the hand grip 77. In most installations the newspapers are dispensed only upon deposit of a coin or coins in a pay box 78 of standard construction. The box 78 is mounted for easy access at the front wall of the enclosure. Preferably, the pay box is arranged to permit swinging of the handle 74 only after appropriate coin deposit has been made. A representative connection between the pay box 78 and the handle 74 is diagrammatically illustrated in FIG. 5. A hook 79 on the lever handle 74 is restrained by a detent 81 actuated by the coin box. Only when the coin box has been supplied and permits the detent 81 to drop is the hook 79 free to permit handle operation and dispensing of a newspaper.

The individual drum cams 51 are especially contoured. Each drum cam 51 (see FIGS. 6, 7, 8 and 9) includes an eccentric fin portion 82 in part approximately even with the drum surface 83 of the adjacent portion of the drum cam and in part extending a much greater radial distance therefrom. The drum cam surface 83 may be relatively flat in part, but varies in contour at different portions of the drum cam periphery. There may be an axial, relatively flat portion for normal support of a newspaper when the drum cam is in home position, but preferably the drum cam surface near home position may have a groove 84 rather deep at home position and tapering to nothingness either side thereof.

In the normal use of the structure and with the handle 74 in inactive position, the cover or top wall 15 is unlocked and placed out of the way. An attendant places a number of newspapers within the enclosure between the rods 41 and 42. These rest on the bottom plate 26. The foremost newspaper is supported on the forward portion of the bottom plate 26 against the barrier 19 and resting on or just above the two drum cams 51 in their home positions. To arrange this, the attendant first retracts the back wall 38, thus tensioning the springs 46. He then releases the back wall so that the introduced newspapers are compacted one against the other and are urged forwardly and downwardly along the bottom plate 26. The foremost newspaper serves as a stop because it rests against the angle barrier 19.

Figure 2:
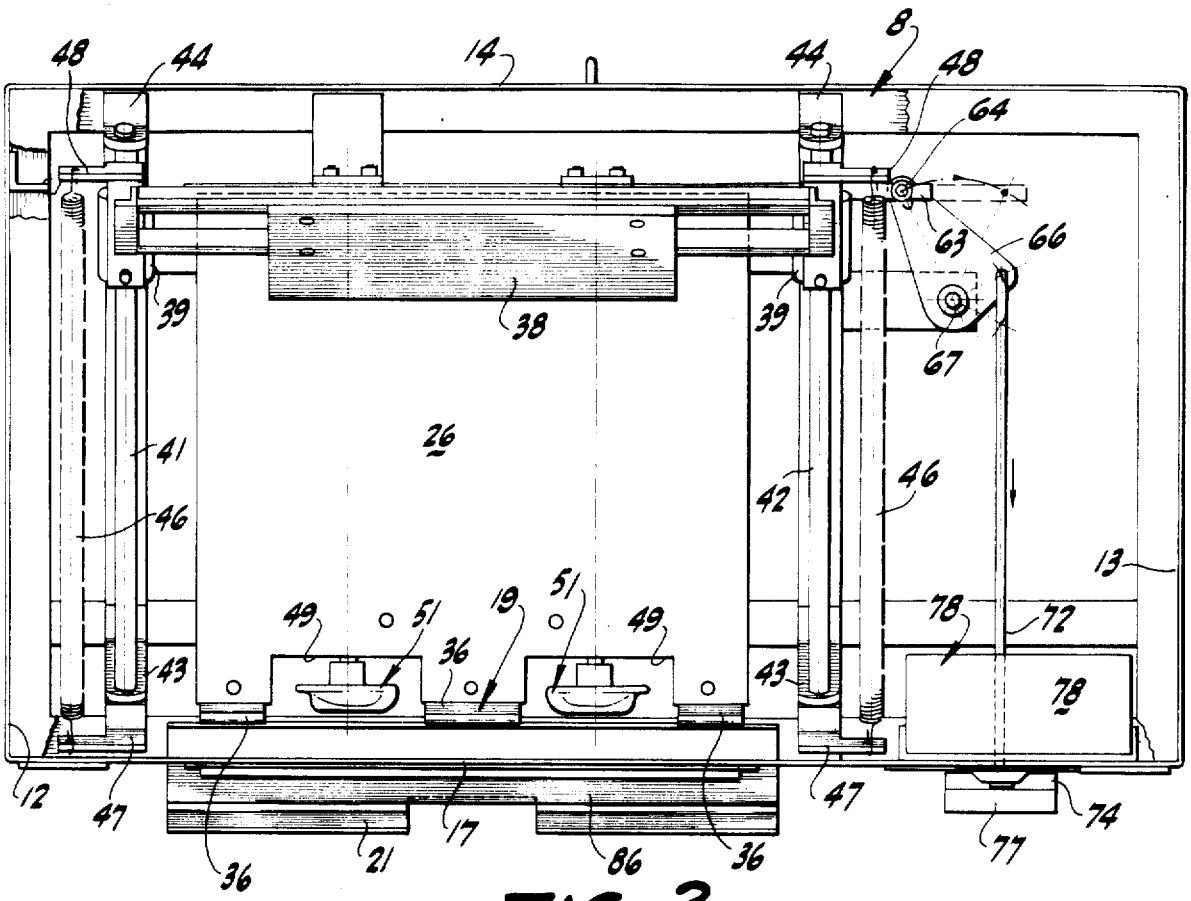
FIG. 2 is a plan of the machine with the cover removed.

When the cover 15 is put back into position and locked, the device is ready for dispensing. A prospective purchaser introduces a coin or coins into the pay box 78, which action withdraws the detent 81. This releases the handle 74 for operation. The user then pulls the handle, thus advancing the rod 72 and rotating the bell crank plate 66 in a clockwise direction, as seen in FIG. 2. Thus, both of the racks 63 and 69 are translated simultaneously and the restoring spring 75 is tensioned. The racks rotate the engaged pinions 61 and 62. The shafts 52 and the drum cams 51 are together rotated in opposite directions. As the drum cams turn, the cam fins 82 in effect gradually rise as they rotate and intrude themselves between the rear of the forward newspaper and the front portion of the adjacent newspaper.

Each cam fin 82 merges with a portion of the cam drum having an increased eccentric radius and in effect farther from its shaft 52 in its subsequent portions and positions. The forward newspaper 31 is thus not only separated from the next adjacent newspaper 32, but itself is at its lower end moved toward and lifted above the barrier 19.

The portions of the cam fins of greater axial extent and cam drums of increased radius both lift and advance the foremost newspaper 31 by pressing upwardly and forwardly against the region of the fold 33 thereof. The separated, forward newspaper is lifted above and across the barrier 19 and into a chute 87 defined by and lying between the front wall 17 and a separating wall 88. At the bottom, the wall 88 is joined to the shelves 21. The chute 87 is sufficiently restricted in transverse area and is long enough so that it is virtually impossible to gain access through it from the outside to the stored newspapers. But the newspaper that is lifted over and advanced across the barrier 19, no longer being supported from below, falls by gravity through the chute 87 onto the shelves 21 for access through the opening 18 by the purchaser. Preferably, the opening 18 is bounded by a protecting shield 86 or roof extending outwardly and downwardly so as to overlie most of the dispensed newspaper. The boundaries define an elongated and tortuous path through which a newspaper can be dropped and withdrawn and which serves to inhibit pilfering of additional newspapers from the device.

When the first newspaper has been dispensed by maximum motion of the handle 74 and the handle is then released, the return spring 75 restores the handle mechanism to its original position. The resulting motion of the racks and rods causes a return motion of the drum cams so that they retreat to their original rest or home position. When that has occurred and the cam fins 82 are again out of the way, the pressure of the back wall 38, under the urgency of its springs 46, advances the entire group of newspapers forwardly along the bottom plate 26. The new, forward or foremost newspaper comes to rest, like its predecessor, against the barrier 19 and near and over the tops of the two drum cams 51. The machine is then ready for a subsequent operation.

We claim:

1. A newspaper vending machine comprising a frame including an enclosure; means defining a dispensing opening in one wall of said enclosure; a bottom plate on said frame inclined downwardly toward said opening for supporting a plurality of folded, rectangular newspapers disposed substantially upright adjacent to each other and with the folds thereof resting on said bottom plate; a transverse barrier upstanding from said bottom plate adjacent said opening; cam means adjacent said barrier on the side thereof opposite said opening for engaging and lifting that one of the plurality of newspapers as is nearest said barrier and for separating the one engaged newspaper from the remainder of the plurality of newspapers, said cam means having a circumferential, part toroidal groove for supporting and moving the one engaged newspaper and a fin portion adjacent said groove for intrusion between the one engaged newspaper and an adjacent newspaper; and means mounting said cam means for rotation about an axis accentric to said groove and said fin portion for engaging said cam means against the fold of the one newspaper to lift said newspaper above said barrier and to urge said lifted newspaper over said barrier and into said dispensing opening while blocking the adjacent newspaper from movement toward said barrier.

2. A device as in claim 1 including means for urging said newspapers on said bottom plate forwardly toward said barrier.

3. A device as in claim 1 including a plurality of said drum cams transversely spaced apart under different portions of the foremost one of said newspapers, and means for operating said drum cams simultaneously.

4. A device as in claim 3 including means for operating said drum cams simultaneously in opposite directions.

5. A device as in claim 1 including a manual operator for rotating said drum cam, and releasable means for inhibiting the operation of said drum cam by said manual operator.

6. A device as in claim 1 including a return spring tensioned by operation of said drum cam rotating means.

7. A newspaper vending maching comprising an enclosure having a dispensing opening therein at a predetermined elevation, means in said enclosure for supporting a folded newspaper with the folded edge thereof at an elevation lower than said predetermined elevation, and means for lifting said folded newspaper from said lower elevation up to said predetermined elevation and into position to discharge by gravity through said opening, said last named means including cam means adjacent said opening for engaging and lifting the folded newspaper and for separating the engaged newspaper from any adjacent newspaper, said cam means having a circumferential, part toroidal groove for supporting and moving the one engaged newspaper and a fin portion adjacent said groove for intrusion between the one engaged newspaper and an adjacent newspaper, and means mounting said cam means for rotation about an axis eccentric to said groove and said fin portion for engaging said cam means against the fold of the folded newspaper to lift the newspaper and to urge the lifted newspaper into said dispensing opening while blocking the adjacent newspaper from movement toward said opening.

8. A device as in claim 7 in which said opening is defined in a chute having an upper end at said predetermined elevation and having a lower end below said predetermined elevation a distance substantially equal to the height of said folded newspaper, and said chute is enclosed except for a portion at the lower end thereof to release a single one of said newspapers.

9. A device as in claim 7 in which said lifting means includes a cam surface for elevating a newspaper at said predetermined elevation by engagement with the fold thereof and includes a cam surface for moving an elevated newspaper at said predetermined elevation into said dispensing opening.

10. A device as in claim 7 in which said lifting means includes a cam surface adapted to engage the fold of said newspaper from below and lift said engaged newspaper to said predetermined elevation and to urge said engaged newspaper off of said cam surface at said predetermined elevation.

* * * * *